US006378847B2

(12) United States Patent
Rexford et al.

(10) Patent No.: US 6,378,847 B2
(45) Date of Patent: Apr. 30, 2002

(54) MONOLITHIC CERAMIC GAS DIFFUSER FOR INJECTING GAS INTO A MOLTEN METAL BATH

(76) Inventors: Donald G. Rexford, 1623 Mariaville Scotch Church Rd., Pattersonville, NY (US) 12137; David A. Larsen, 7 Whispering Hills Dr.; Earle R. Webster, Jr., 8 Trevor Ct., both of Clifton Park, NY (US) 12065

( * ) Notice: Subject to any disclaimer, the term of this patent is extended or adjusted under 35 U.S.C. 154(b) by 0 days.

(21) Appl. No.: 09/736,818

(22) Filed: Dec. 14, 2000

Related U.S. Application Data

(62) Division of application No. 09/324,059, filed on Jun. 1, 1999, now Pat. No. 6,199,836.
(60) Provisional application No. 60/109,868, filed on Nov. 24, 1998.

(51) Int. Cl.[7] ..... B01F 3/04
(52) U.S. Cl. ..... 261/122.1; 261/121.1
(58) Field of Search ..... 261/122.1, 96, 261/105, 121.1, 126, DIG. 47, DIG. 70

(56) References Cited

U.S. PATENT DOCUMENTS

| | | | | |
|---|---|---|---|---|
| 3,227,547 A | | 1/1966 | Szekely | |
| 3,330,645 A | * | 7/1967 | De Moustier et al. | 261/122.1 |
| 3,650,513 A | | 3/1972 | Werner | |
| 3,881,709 A | | 5/1975 | Steen | |
| 3,970,731 A | | 7/1976 | Oksman | |
| 3,982,913 A | | 9/1976 | Feichtinger | |
| 4,426,068 A | | 1/1984 | Gimond et al. | |
| 4,611,790 A | | 9/1986 | Otsuka et al. | |
| 4,618,427 A | | 10/1986 | Venas | |
| 4,802,656 A | | 2/1989 | Hudault et al. | |
| 4,820,412 A | * | 4/1989 | Meyer-Rudolphi et al. | 261/DIG. 70 |
| 4,973,433 A | * | 11/1990 | Gilbert et al. | 261/122.1 |
| 5,013,490 A | | 5/1991 | Tanimoto et al. | |
| 5,364,078 A | | 11/1994 | Pelton | |
| 5,422,323 A | * | 6/1995 | Banerjee et al. | 501/100 |
| 5,560,874 A | | 10/1996 | Sheckler et al. | |
| 5,626,692 A | * | 5/1997 | Rohatgi et al. | 148/538 |
| 5,678,807 A | | 10/1997 | Cooper | |
| 5,863,031 A | | 1/1999 | Veeder et al. | |

FOREIGN PATENT DOCUMENTS

| | | |
|---|---|---|
| BE | 489718 A | 6/1949 |
| DE | 40 12 952 C1 | 8/1991 |
| EP | 0 819 770 A1 | 1/1998 |
| FR | 2 763 079 | 11/1998 |
| WO | WO 92/04473 | 3/1992 |

OTHER PUBLICATIONS

Patent Abstracts of Japan, vol. 008, No. 126 (C–228), Jun. 13, 1984 & JP 59 038321 A (Sumitomo Kinzoku Kogyo KK), Mar. 2, 1984 *abstract*.

Larsen, D.A., "Degassing Aluminum Using Static Fine–Pore Refractory Diffusers," JOM, US, Minerals, Metals and Materials Society, Warrendale, vol. 49, No. 8, Aug. 1, 1997, pp 27–28.

Patent Abstracts of Japan, vol. 013, No. 153 (M–813), Apr. 13, 1989, & JP 63 313631 A (Nittoku Fuaanesu KK), Dec. 21, 1988 *abstract*.

* cited by examiner

*Primary Examiner*—Duane Smith
*Assistant Examiner*—Jason M. Greene
(74) *Attorney, Agent, or Firm*—Burr & Brown

(57) ABSTRACT

A monolithic, fired ceramic gas diffuser for injecting gas into a molten metal bath, including a first portion, a second portion integrated with the first portion, and a bore passing through the first portion and communicating with the second portion for supplying gas to the second portion, wherein at least the second portion has a network of interconnected pores that provides preferential gas flow from the bore through the second portion to inject gas into the molten metal bath.

7 Claims, 9 Drawing Sheets

FIG. 1 - PRIOR ART

FIG. 2 - PRIOR ART

FIG. 3 - PRIOR ART

MONOLITHIC CERAMIC GAS DIFFUSER FOR INJECTING GAS INTO A MOLTEN METAL BATH

This is a divisional application of U.S. application Ser. No. 09/324,059, filed Jun. 1, 1999, now allowed U.S. Pat. No. 66,199,836, which is the nonprovisional of U.S. Provisional Application Serial No. 60/109,868, filed Nov. 24, 1998, the entirety of which is incorporated herein by reference.

BACKGROUND OF THE INVENTION

The present invention relates to a monolithic ceramic gas diffuser for injecting gas into a molten metal bath, and more particularly relates to such a diffuser that includes a portion through which injection gas will preferentially flow.

When making metal and metal alloy products, it is often necessary to create a bath of molten metal that will later be cast into molds of various shapes and sizes. With certain specific alloys, such as aluminum alloys, the molten aluminum is highly sensitive to the presence of hydrogen gas, which tends to form voids in the cast product. Additionally, molten aluminum oxidizes freely when exposed to air, and the resultant aluminum oxide has a density very similar to the metal itself. This results in aluminum oxide being suspended in the melt, causing "hard spots" upon solidification, an undesirable result.

In an attempt to prevent both problems, it is conventional to inject a "cleansing gas" such as argon, nitrogen, chlorine, or freon into the molten aluminum in the form of gas bubbles. The hydrogen in the molten aluminum is either absorbed or attaches to the cleansing gas bubbles, which rise to and exit from the surface of the molten aluminum. Additionally, any aluminum oxide suspended in the molten aluminum can be floated to the surface by the gas bubbles. This is a mechanical process, and is basically independent of the type of gas used.

FIG. 1 shows a holding box 1 that contains molten metal 2 therein. Gas injection nozzles or spargers 3 are located at various positions in communication with the molten metal to inject gas, supplied from a gas supply line 4, into the molten metal. FIG. 2 shows an example of an existing sparger that typically would be positioned in the floor of holding box 1. The sparger 5 includes a highly permeable ceramic member 6 encased in a steel can 7 through an interposed refractory or mortar adhesive 8. A gas supply pipe 9 supplies gas to the permeable ceramic member 6 to inject gas into the molten metal.

The problem with the sparger shown in FIG. 2 is that it requires the presence of steel can 7 to encase the permeable ceramic member 6 to insure that gas bubbles are injected only through the end face of permeable ceramic member 6 into the molten metal. Consequently, the sparger shown in FIG. 2 is relatively expensive to manufacture. Moreover, the sparger is susceptible to cracking at the interfaces between permeable ceramic member 6, mortar 8 and steel can 7, due to the differences in thermal expansion coefficient among the various materials. Still further, the permeable ceramic member 6 used in such conventional spargers have large pore size, generally greater than 30 microns in diameter, and thus the size of the gas bubbles injected into the molten metal is relatively large. It would be preferred to inject smaller gas bubbles as they would be more effective in removal of the hydrogen gas contained in the molten metal, thus requiring less gas volume to accomplish degassing of the molten metal.

FIG. 3 shows another example of a gas injection mechanism in the form of a generally cylindrical graphite lance 10. The lance is immersed in the molten metal and gas is introduced through the relatively large opening 11 formed in the end of the lance. The problem with such graphite or other ceramic lances is similar to the problem associated with the sparger shown in FIG. 2, in that it is difficult to inject small gas bubbles into the molten metal using such a device. Moreover, graphite tends to oxidize and corrode, and is also rather fragile; thus it requires frequent replacement.

FIG. 4 shows an example of a rotary degasser developed by Blasch Precision Ceramics, Inc. The rotary degasser 12 includes an elongate shaft 13 having an axial bore 14 extending therethrough, and an impeller 15 integrated with one end of shaft 13. The impeller has a plurality of blades 16 extending radially outwardly from the axis of shaft 13, and gas ports 14*a* passing radially outwardly through the impeller. The rotary degasser is immersed in molten metal and rotated by a drive member (not shown) while gas is injected into the molten metal through ports 14*a* and a large opening 17 formed in the end face of impeller 15. Rotation of the impeller facilitates mixing of the injected gas with the molten metal. The problem with this rotary degasser, however, is that the size of the gas bubbles introduced into the molten metal is still quite large, and thus relatively inefficient for degassing the molten metal.

It would be desirable to provide a gas diffuser that is (1) highly resistant to cracking due to thermal cycling and other factors encountered during molten metal manufacturing, (2) capable of injecting uniform, relatively small gas bubbles into a bath of molten metal, and (3) relatively easy and inexpensive to manufacture. The gas diffusers to date, however, have not been able to fulfill all of these requirements.

SUMMARY OF THE INVENTION

It is an object of the present invention to provide a gas diffuser that overcomes all the drawbacks associated with the prior art discussed above.

In accordance with a first object of the present invention, a monolithic, fired ceramic gas diffuser is provided, which includes a first portion, a second portion integrated with the first portion, and a bore passing through the second portion and communicating with the first portion for supplying injection gas to the first portion. At least the first portion has a network of interconnected pores that provide preferential gas flow (i.e., a path of least resistance) through the first portion to inject gas into the molten metal bath.

The gas diff-user of the present invention is highly resistant to cracking as a result of thermal cycling since it is produced as a monolithic ceramic body. There are no lamination interfaces of substantially dissimilar material, such as in the sparger shown in FIG. 2, that would invite cracking problems. Additionally, the network of interconnected pores in the first portion of the gas diffuser can be engineered quite easily to enable the injection of very uniform, small bubbles of gas into the molten metal. Still further, the gas diffuser of the present invention is relatively easy and inexpensive to manufacture, as it can be produced using conventionally available materials and conventionally recognized processing techniques, such as those disclosed in U.S. Pat. Nos. 4,246,209 and 4,569,920, the entireties of which are incorporated herein by reference.

In accordance with a preferred embodiment of the present invention, the gas flow characteristics of the first and second portions of the monolithic ceramic gas diffuser are controlled to provide preferential gas flow through the first portion of the diffuser. More preferably, the gas flow characteristics are controlled by varying the permeability and/or thickness (in the gas flow direction) of the first and second portions. It is most preferable that the permeability of the second portion is less than the permeability of the first portion, so that the first portion defines a so-called path of least resistance in the gas diffuser through which the injection gas is more likely to pass. Accordingly, the specific geometry of the gas diffuser can be selected so that the first portion thereof is located in a position that will provide the most efficient injection of gas into the molten metal.

It is another object of the present invention to provide a monolithic, fired ceramic rotary gas diffuser for injecting gas into a molten metal bath, which includes an elongate shaft having an axial bore passing therethrough and an impeller integrated with one end of the shaft. At least a portion of the impeller has a network of interconnected pores that provide preferential gas flow (i.e., a path of least resistance) from the bore through the impeller portion to inject gas into the molten metal bath. This embodiment of the present invention incorporates the inventive gas diffuser into a rotary shaft/impeller configuration, to obtain the mixing functionality that is added by an impeller configuration.

These and other objects of the present invention will become more apparent after reading the following detailed description of the invention taken in conjunction with the appended drawings.

DETAILED DESCRIPTION OF THE INVENTION

Figure 5:
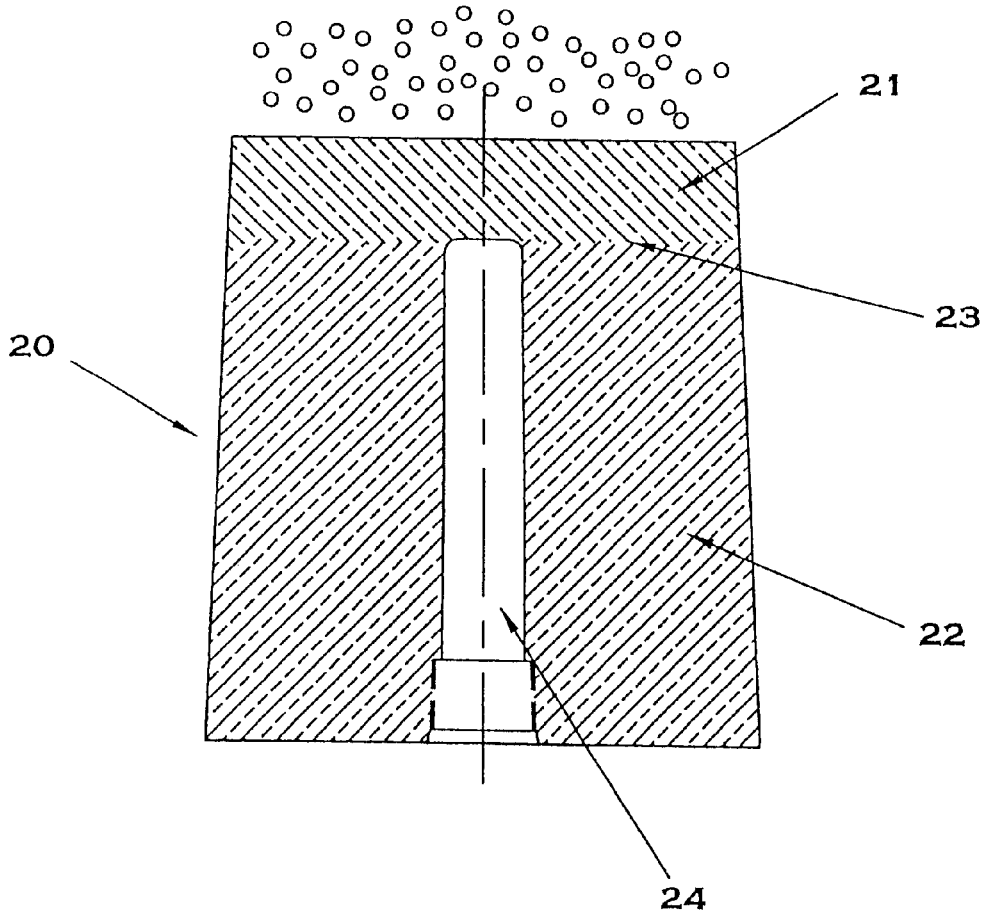
FIG. 5 is a cross-sectional view of a sparger according to the present invention.

FIG. 5 is a cross-sectional view showing an example of the present invention in the form of a sparger 20. The sparger generally takes the shape of a truncated cone, and is formed as a monolithic ceramic structure including a first tip portion 21 and a second main body portion 22 that is integrated with the bottom end region of first portion 21. A commingled region 23 can be detected optically between the first and second portions of the fired body, and generally is a hybrid of the two portions. There is no interfacial lamination to speak of, however, between the two portions. A bore 24 extends through second portion 22 and communicates with first portion 21. Injection gas is supplied through bore 24 and is ejected out of the end of sparger 20 through first portion 21.

In accordance with the present invention, the gas flow characteristics of the first 21 and second 22 portions are selected such that there is a preference for the injection gas to flow through first portion 21 (i.e., portion 21 is a path of least resistance when compared to portion 22). As a result, portion 22 effectively acts to form the foundation of the sparger 20 and defines a conduit (bore 24) for transporting gas to and through first portion 21.

It is preferred to control the gas flow characteristics of first portion 21 and second portion 22 so that first portion 21 provides a path of least resistance for the gas introduced into bore 24. One way of doing this is to control the permeability of the two portions such that first portion 21 is substantially more permeable than second portion 22. One skilled in the art will understand that gas flow characteristics of a ceramic body depend upon the permeability of that body and the thickness thereof in the direction of gas flow. Accordingly, when it is stated that first portion 21 is "more permeable" than second portion 22, this can be accomplished by varying the permeability and/or thickness (in the direction of gas flow) of those portions. Although not absolutely necessary, it is usually the case that first portion 21 is thinner (in the direction of gas flow) and more permeable than second portion 22, and also has higher porosity than second portion 22.

As a result of the process used to form sparger 20, which will be discussed in more detail later herein, first portion 21 and second portion 22 include a network of interconnected pores through which fluid (e.g., gas) can flow. Accordingly, while second portion 22 may in fact be permeable, in accordance with the present invention, first portion 21 is made more permeable to provide preferential gas flow through first portion 21 as opposed to second portion 22.

Any known ceramic material could be used to make the gas diffuser shown in FIG. 5. It is desirable, however, that the material have sufficient refractory properties and be substantially non-reactive with the molten metal with which it will contact. Examples of ceramic materials that could be used include alumina, silica, silicon carbide, magnesia, alumina magnesia spinel, aluminum titanate, zirconia, mullite, sillimanite, cordierite and composites and mixtures thereof. Again, the specific material selected will depend largely upon the molten metal with which the part will be used.

Since these types of gas diffusers are considered consumable components regardless of the materials used to form them, and thus will have a tendency to chip or break over time, it is preferred to make the diffuser from a ceramic material having a lower density than that of the molten metal with which it will be used. This will ensure that any parts of the gas diffuser that might chip or break during use would float to the top of the molten metal for easy removal (along with alumina precipitates in the case of an aluminum melt).

The gas diffuser shown in FIG. 5 can be formed in accordance with conventional ceramic processing techniques, such as those disclosed in U.S. Pat. Nos. 4,246,209 and 4,569,920. However, one exemplary method for forming the gas diffuser shown in FIG. 5 will now be explained.

Two ceramic batches are prepared to form each of the respective first and second portions 21 and 22. While not critical, it is preferred that the compositions of the two batches are substantially identical except for the addition of a standard pore forming agent (and sometimes additional water or aqueous liquid) in the first batch that will be used to form first portion 21. The amount of pore forming agent included in the first batch is also not critical, provided that the first portion 21 of the resultant fired part has adequate strength to withstand gas injection pressures and defines a gas path of least resistance when compared to the second portion 22 of that part.

Once the two batch materials have been separately mixed into a wet, thixotropic state, the first batch material is deposited into a lower, closed end of a mold that effectively defines a negative impression of the gas diffuser shown in FIG. 5. How much of the first batch material added to the mold at this stage will be determined by how thick the first portion 21 of the final product is intended to be. The second batch material used to form second portion 22 is then deposited on top of the first batch material already in the mold and around a columnar shaped member that, when removed after casting, will define bore 24 of the gas diffuser. Of course, the first and second batch materials do not have to be deposited in the mold in this order; the specific geometry of the cast part and the respective positions of the first and second portions will dictate the order in which the batch materials are introduced into the mold.

It is preferred that the mold is vibrated while the batch materials are being added thereto and/or after both batch materials have been introduced into the mold, to facilitate commingling of the two batch materials at least in the interface region therebetween. This will insure that a good bond is created between the two portions during subsequent firing, and thus insure the absence of any structurally weak interfacial joint between the two portions.

After the batch materials have been cast into the mold and vibrated as discussed above, the cast product is further processed and fired using conventional techniques, such as those disclosed in the above-referenced patents. If a freeze casting process is to be used to form the gas diffuser, then it may be desirable to deposit the first batch material in the mold, freeze that portion of the casting until it becomes partially rigid (but not fully solidified), and then vibratory cast the second batch material to form second portion 22. This is one way by which the amount of commingling between the raw materials for first portion 21 and the second portion 22 can be controlled. That is, the first batch material that forms first portion 21 will not commingle as easily if it is in a partially frozen state, as would be the case if this alternative method were employed. The amount of commingling between the two batch materials that is desired, or that can be tolerated, can be controlled in this manner. In the case of a relatively thin first portion 21, it may be necessary to employ this alternative method to prevent complete commingling of the two batch materials during the vibratory casting process. That is, if the thickness of first portion 21, and thus the amount of the raw material added to the mold to form that portion, is relatively small compared to the thickness of second portion 22, and thus the amount of raw material cast into the mold to form that portion, the action of vibrating the mold could easily consume the entirety of the first batch material intended to form first portion 21. In such a case, it would be preferable to freeze the first batch material that is to form first portion 21 before vibratory casting the second batch material that is to form second portion 22.

The formation techniques discussed above are effective to provide a monolithic ceramic gas diffuser having first and second portions of substantially different gas permeability, while avoiding any significant interfacial laminations that might crack during thermal cycling. The integrity of the commingled region between first portion 21 and second portion 22 in the fired ceramic product can be improved by using the same ceramic raw materials in the batch compositions for the first 21 and second 22 portions. The only difference, again, would be that the first batch material used to form first portion 21 would have a higher content of pore forming agent (and sometimes additional water or aqueous liquid) so that, when fired, the first portion will allow the passage of gas therethrough more readily than through second portion 22. To the extent the fired ceramic part will not be subjected to significant thermal cycling, it could be possible to employ dissimilar compositions when forming the first portion 21 and second portion 22. In this regard, the materials used for each portion should be selected with a view to matching the thermal expansion coefficients of each material sufficiently enough to prevent cracking and/or delamination at the commingled region between the two portions.

While there is no particular limit on the permeability of the first portion 21 and second portion 22, from a practical standpoint the second portion 22 should have a permeability of 10 centidarcies or less, and the first portion 21 should have a permeability of 5 centidarcies or more, the important point being that the difference between the gas flow characteristics through each portion is substantial enough to provide a preferential gas path through first portion 21 as opposed to second portion 22.

Although there is also no particular limitation on the size of the pores contained in the first portion 21 and second portion 22, from a practical standpoint the pore size in the first portion 21 should range from 3 microns to 25 microns in diameter to provide reduced gas bubble size in application. Pore size is not critical in the second portion 22 as long as there is preferential gas path through first portion 21 as opposed to second portion 22. If the pore size is the same in both portions, the first portion 21 should contain a higher volume of open porosity to insure preferential gas flow therethrough.

Figure 6A:
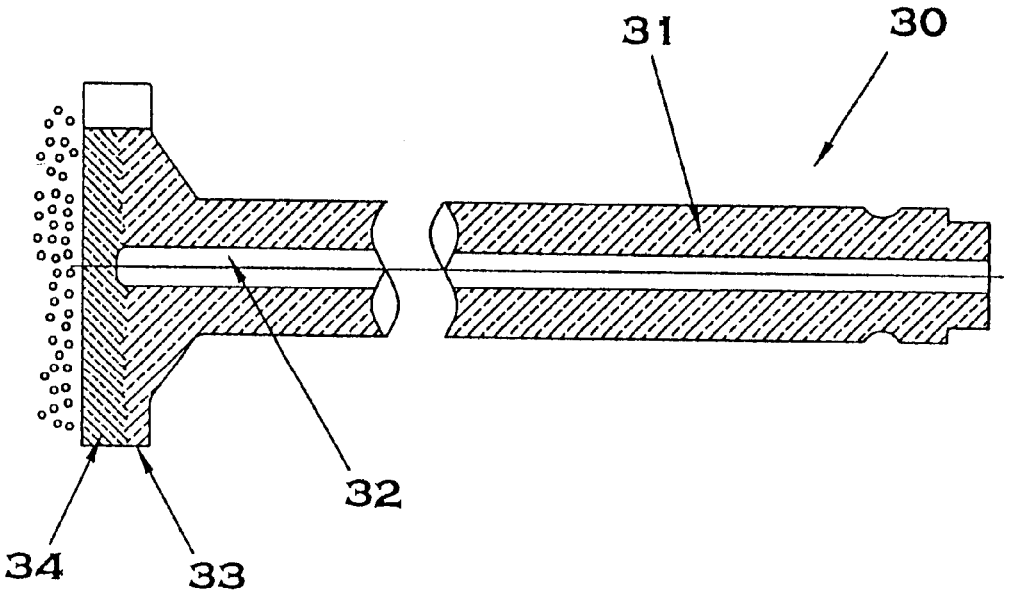
FIGS. 6A and 6B are cross-sectional and end views of a rotary gas diffuser according to the present invention.
Figure 6B:
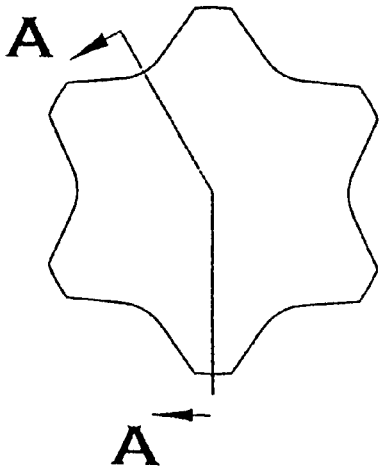

FIGS. 6A and 6B are cross-sectional and end views, respectively, of a rotary gas diffuser 30 according to the present invention. The rotary gas diffuser includes an elongate shaft 31 having an axial bore 32 passing therethrough. An impeller 33 is integrated to one end of shaft 31. A surface portion 34 of impeller 33 has gas flow characteristics that, when compared to the gas flow characteristics of the remaining portions of the rotary gas diffuser, provide preferential gas flow therethrough from axial bore 32 into the molten metal bath with which the rotary gas diffuser is used. Aside from the geometric differences between the sparger shown in FIG. 5 and the rotary gas diffuser shown in FIG. 6, all of the features described above with respect to the sparger shown in FIG. 5 apply equally as well to the rotary gas diffuser shown in FIGS. 6A and 6B.

Figure 7A:
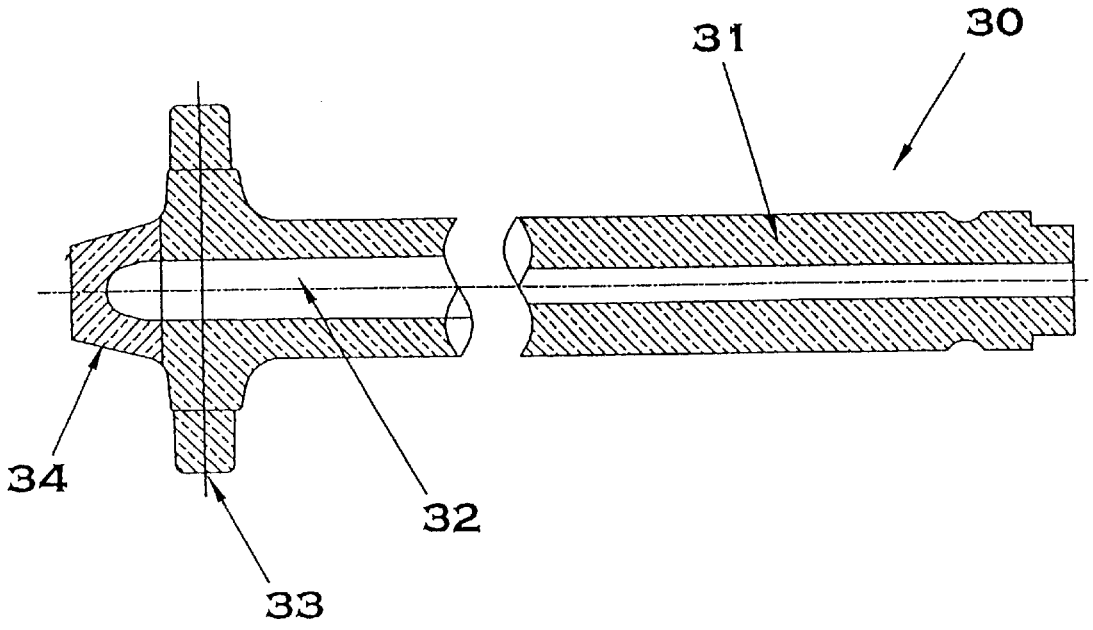
FIGS. 7A and 7B are cross-sectional and end views of an alternative rotary gas diffuser according to the present invention.
Figure 7B:
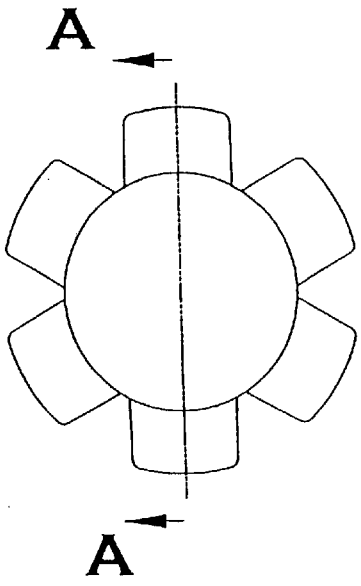

FIGS. 7A and 7B are cross-sectional and end views of an alternative rotary gas diffuser according to the present invention. Like reference numerals are used in FIGS. 6 and 7 to designate like parts. The end face 34 of the rotary gas diffuser 30 shown in FIG. 7A takes the shape of a truncated cone, at least a portion of which defines a path of least resistance for injecting gas into the molten metal. Since rotary gas diffusers are typically oriented vertically, there is a tendency for gas bubbles to collect on the planar bottom face of the impeller shown in FIG. 6A. Such trapped gas agglomerates to form large-sized bubbles which periodically separate from the end face of the gas diffuser and mix with the molten metal. The introduction of such large-sized gas bubbles into the molten metal makes the overall degassing process less efficient, as described above in connection with prior art gas diffusers. The shape of the end face of the rotary gas diffuser in FIG. 7 is designed to minimize the area on which gas bubbles could agglomerate. Accordingly, the small-sized gas bubbles made available by the present invention can be better maintained.

Figure 8:
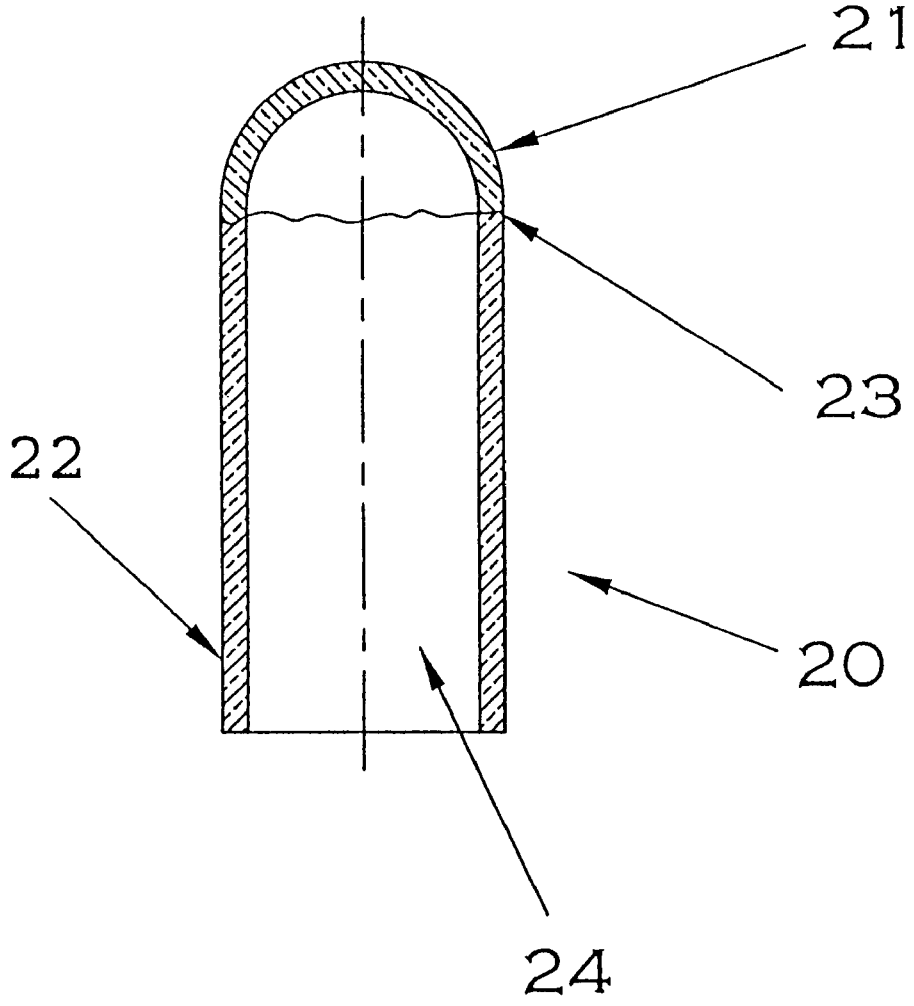
FIG. 8 is a cross-sectional view of a lance according to the present invention.

FIG. 8 is a cross-sectional view showing a generally cylindrical lance according to the present invention. Like reference numerals have been used in FIGS. 5 and 8 to designate like features of the respective structures. Aside from differences in geometric size and shape, the features in connection with the sparger of FIG. 5 apply equally as well to the lance shown in FIG. 8.

Figure 9:
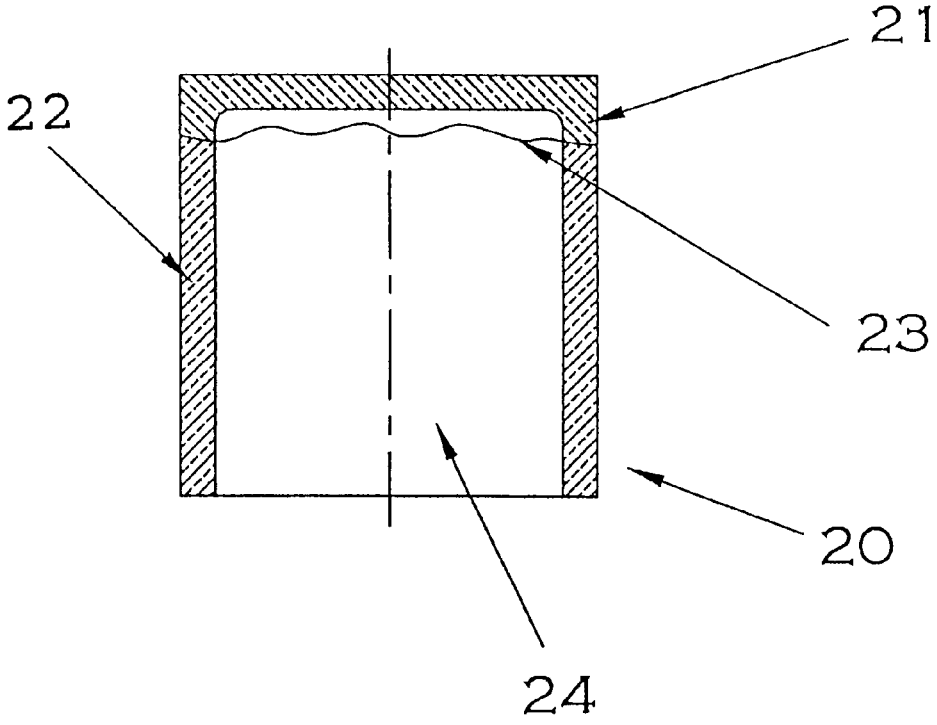
FIG. 9 is a cross-sectional view of an alternative sparger according to the present invention.

FIG. 9 is a cross-sectional view showing a different shape that could be used to form a sparger like the one shown in FIG. 5. The sparger shown in FIG. 9 could be any shape (e.g., circular, square, etc.) in radial cross-section. Like reference numerals have been used in FIGS. 5 and 9 to designate like parts.

Figure 1:
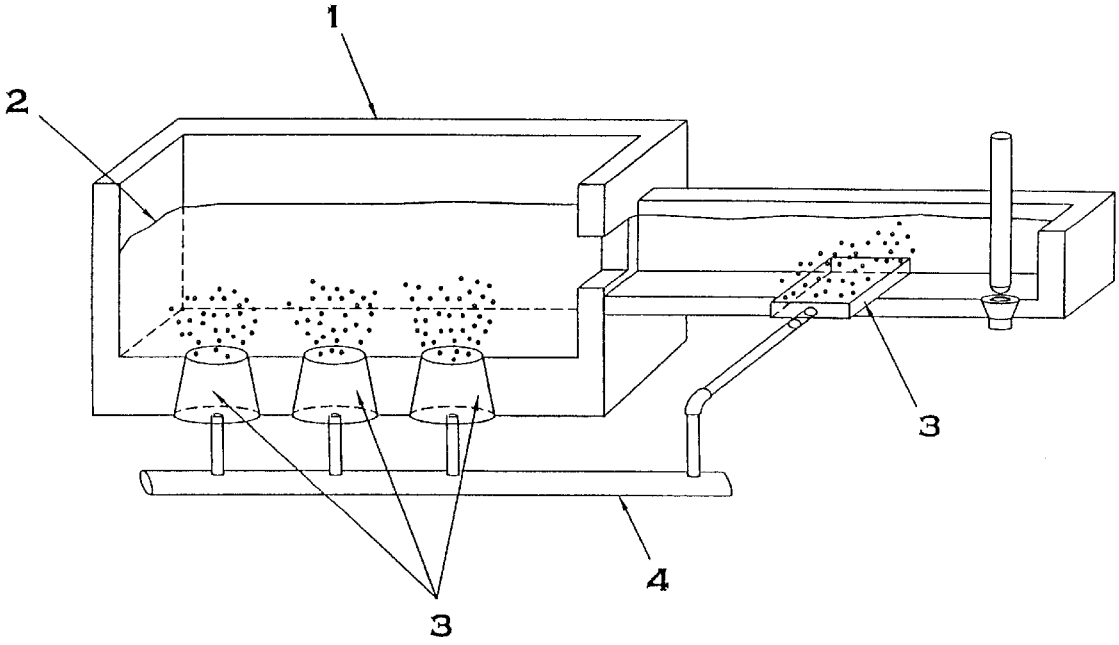
FIG. 1 is a diagram showing a conventional molten metal holding box used in the production of cast metal parts.
Figure 2:
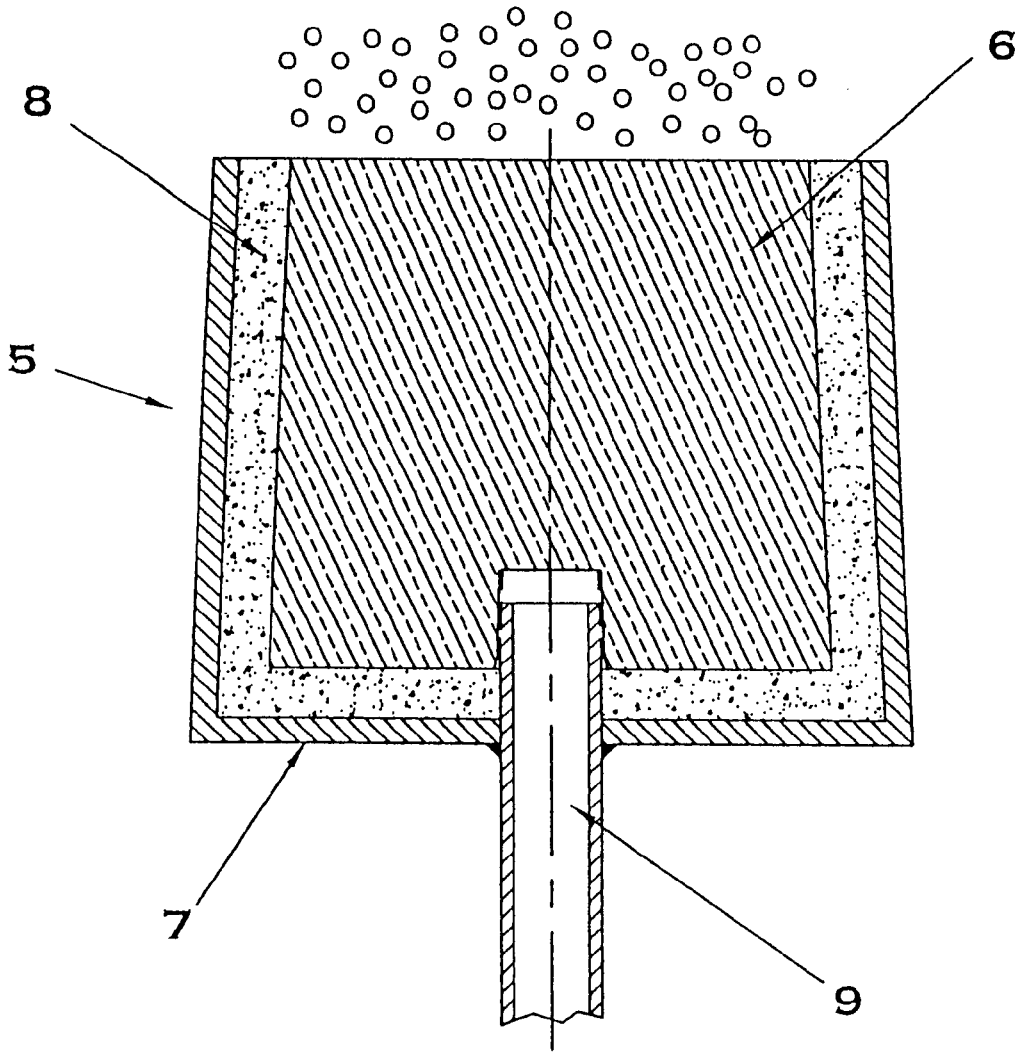
FIG. 2 is a cross-sectional view of a prior art sparger.
Figure 3:
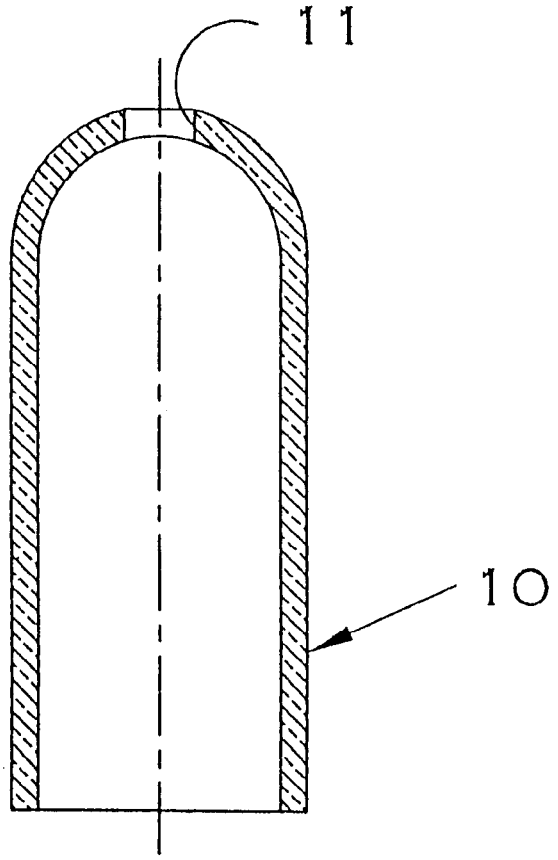
FIG. 3 is a cross-sectional view of a prior art lance.
Figure 4:
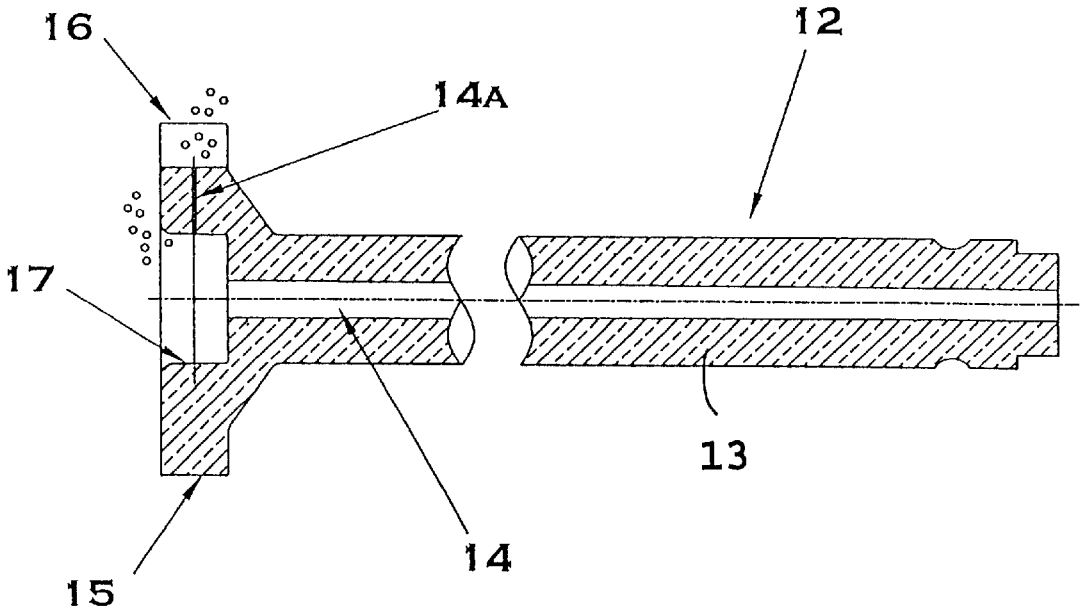
FIG. 4 is a cross-sectional view of a rotary degasser.

The structure of the presently claimed gas diffuser overcomes all of the drawbacks associated with the prior art discussed above and also enables the formation of smaller, more uniform gas bubbles to be injected into the molten metal. As a result, the volume of gas necessary to accomplish the same degassing objectives sought by the prior art devices is substantially reduced. For example, it has been estimated that the rotary degasser shown in FIG. 4 would need approximately five times the volume of injection gas to accomplish the same degassing result that can be accomplished using the rotary degasser shown in FIG. 6. Accordingly, not only is the rotary degasser of the present invention more durable and easier and cheaper to manufacture than conventional gas diffusers, it also provides a substantial savings in the amount of injection gas that is required to degas a given molten metal batch.

The following examples provide more detail about specific embodiments of the present invention. One skilled in the art, however, will understand that various changes and modifications could be made without departing from the spirit of the present invention.

EXAMPLE 1

For application in degassing of molten aluminum, a monolithic, fired ceramic diffuser was formed in the shape of a lance tube, substantially as shown in FIG. 8. The method employed will be explained.

A metal mold was prepared. It was a negative impression of a lance tube of nominal size of 2 inches outside diameter× 0.5 inches thick×24 inches long, with one end open and the other end closed with a rounded shape. Two individual batches of ceramic mix were batched and mixed separately. The two batches were viscous, similar in consistency to wet concrete mix or slightly thicker, and both included silicon carbide, alumina, boron nitride, silica sol, and lipolysilicate. Also, in the case of the first batch used to form first portion 21, organic fillers and additional aqueous silica sol were included in the mixture to impart additional porosity and permeability. The second batch was used to form second portion 22 and the first batch was used to form first portion 21.

More specifically, the composition of the first batch included 70.5 wt % SiC grains (refractory grade), 5.0 wt % tabular alumina grains, 24.0 wt % reactive alumina powder, 0.5 wt % boron nitride powder, 21.2 wt % silica sol, 0.10 wt % lithium polysilicate and 1.8 wt % organic pore former, and the composition of the second batch included 70.5 wt % SiC grains (refractory grade), 5.0 wt % tabular alumina grains, 24.0 wt % reactive alumina powder, 0.5 wt % boron nitride powder, 10.5 wt % silica sol and 0.10 wt % lithium polysilicate.

It was calculated that, for the geometry of this lance and based upon the density of the first batch, it would require about 480 grams of wet mix to fill the lower 4 to 6 inches of length of the mold to form the first end portion 21. Thus, this amount of wet ceramic was weighed out and placed in a container. The mold was then rigged for vibration, and the wet first batch was cast into the mold while it was being vibrated. Immediately following the placement of the premeasured amount of first batch into the mold, a predetermined amount of second batch (in a wet state) was added directly on top of the first batch while the mold was still under vibration. Once the mold was filled, the vibration was discontinued, and the filled mold was refrigerated in a freezing environment until solidification occurred (in accordance with the method described in U.S. Pat. Nos. 4,246,209 and 4,569,920). The filled mold was removed from the freezing environment and disassembled. The frozen ceramic shape was warmed to thaw and air dried, followed by firing in a kiln at 1700° F. for 1–2 hours hold time to form a monolithic ceramic in the shape of a lance tube. Upon inspection, there was no discernible joint, seam or crack(s) between first portion 21 and second portion 22.

The open end of the lance tube was connected to a regulated air line with approximately 3 to 5 psi pressure, and then totally immersed in an aquarium of water, and the air bubbles observed. The bubble pattern showed that nearly 100% of the air bubbles were being emitted from the first portion 21 near the closed end of the tube in the last 6 inches (approximately) of length of the closed end. The observed bubbles were uniform and relatively small in size.

After removal from the aquarium, this ceramic tube was thoroughly dried, and then cut lengthwise in half. The cut tube half-sections were examined under an optical microscope, and no discernible cracks, joints, or seams were observed: the body was monolithic. There was, however, a distinguishable "commningled" ceramic region between the first portion 21 and the second portion 22, which comprised about 1 to 1.5 inches of the total tube length. This conmmingled region had a combination of the microstructures resulting from both the first batch material (used to form first portion 21) and the second batch material (used to form second portion 22).

Fired sample parts made from both the first and second batch compositions were tested to confirm resistance to molten aluminum alloy #7075, with results indicating that these refractory compositions were resistant to this alloy. Additionally, the first and second portions of the fired product were tested, and the nominal properties for these compositions, as fired, including modules of rupture, bulk density, apparent porosity, permeability, thermal expansion coefficient, and calculated chemical analysis, were as follows:

First Portion:

| | |
|---|---|
| Calculated chemical analysis: | 65.2% silicon carbide<br>27.3% alumina<br>6.7% silica<br>0.5% boron nitride |
| Bulk density: | 2.15 g/cc |
| Modulus of Rupture (room temperature): | 9.4 MPa |
| Apparent porosity: | 31.2% |
| Permeability: | 14.5 centidarcies |
| Median Pore Diameter: | 5.3 microns |
| Reversible Linear Thermal Expansion Coefficient: | $5.5 \times 10^{-6}$/degree C. |

Second Portion:

| | |
|---|---|
| Calculated chemical analysis: | 67.3% silicon carbide<br>28.2% alumina<br>3.8% silica<br>0.5% boron nitride |
| Bulk density: | 2.57 g/cc |
| Modulus of Rupture (room temperature): | 30.3 MPa |
| Apparent porosity: | 20.3% |
| Permeability: | 0.5 centidarcies (note: significantly lower in permeability than first portion) |
| Reversible Linear Thermal Expansion Coefficient: | $5.5 \times 10^{-6}$/degree C. |

This preformed monolithic composite ceramic lance would be used in application for degassing of molten aluminum. It would be used by applying pressurized argon (or other suitable cleansing gas) into the inlet of the open end of the tube, and then immersing the closed end into the molten aluminum. The cleansing gas bubbles would be uniform and small, and would provide effective degassing with minimal gas usage.

EXAMPLE 2

The same procedure was used to make the same shape as specified in Example 1, with one procedural exception: After the pre-measured amount of wet first batch material was placed in the vibrating mold to form first portion 21 (in a green state), the vibration was turned-off and the partially filled mold was placed in the freezing environment until the wet mix became more rigid in the mold but not solid. The mold was then removed from the freezing environment, the vibration was again started on the mold, and wet second batch material was added directly on top of the wet (actually somewhat rigid) first batch material already in the mold. Once the mold was filled, the vibration was discontinued, and the filled mold was refrigerated in a freezing environment until solidification occurred (in accordance with the method described in U.S. Pat. Nos. 4,246,209 and 4,569,920). The remaining process for this example was the same as depicted in Example 1. It was also tested in an aquarium filled with water, and the results were the same as in Example 1. Upon comparison of the microstructures of the fired product resulting from each Example, however, it was seen that the product resulting from Example 2 had a thinner commingled region as a result of the freezing step employed after casting of first portion 21.

While the present invention has been particularly shown and described with reference to the preferred mode as illustrated in the drawing, it will be understood by one skilled in the art that various changes in detail may be effected therein without departing from the spirit and scope of the invention as defined by the claims. For example, while it is preferred to use pore forming agents (and sometimes additional water or aqueous liquid) to control the gas flow characteristics of the second portion of the gas diffuser, it is possible to rely instead upon other factors, such as differences in particle size, to establish the requisite preferential gas flow through the second portion.

We claim:

1. A monolithic, fired ceramic gas diffuser for injecting gas into a molten metal bath, comprising:

a first portion;

a second portion integrated with said first portion; and a bore passing through said second portion and communicating with said first portion for supplying gas to said first portion;

wherein at least said first portion has a network of interconnected pores that provides preferential gas flow from said bore through said first portion to inject gas into the molten metal bath.

2. The monolithic ceramic gas diffuser of claim 1, wherein the gas flow characteristics of said first and second portions are controlled to provide preferential gas flow through said first portion.

3. The monolithic ceramic gas diffuser of claim 2, wherein said gas flow characteristics are controlled by varying at least one of the permeability and gas flow thickness of said first and second portions.

4. The monolithic ceramic gas diffuser of claim 1, wherein the permeability of said first portion is greater than the permeability of said second portion.

5. The monolithic ceramic gas diffuser of claim 1, wherein the porosity of said first portion is greater than the porosity of said second portion.

6. The monolithic ceramic gas diffuser of claim 1, wherein the gas flow thickness of said first portion is less than the gas flow thickness of said second portion.

7. The monolithic ceramic gas diffuser of claim 1, wherein the density of the ceramic material used to form the gas diffuser is less than that of the molten metal with which it will be used.

* * * * *